United States Patent [19]

Mory

[11] 3,964,756

[45] June 22, 1976

[54] SKI BINDING

[76] Inventor: Walter Mory, Peintenstrasse 5, A-9800 Spittal, Drau, Austria

[22] Filed: May 14, 1974

[21] Appl. No.: 469,811

[30] Foreign Application Priority Data

May 15, 1973 Austria ..... 4226/73

[52] U.S. Cl. ..... 280/614; 280/615; 280/618

[51] Int. Cl.[2] ..... A63C 9/00

[58] Field of Search ..... 280/11.35 Y, 11.35 E, 280/11.35 B, 11.35 K, 11.35 D, 11.35 A, 11.35 R

[56] References Cited

UNITED STATES PATENTS

| | | | |
|---|---|---|---|
| 1,565,106 | 12/1925 | Reach | 280/11.35 Y |
| 1,593,937 | 7/1926 | Hall | 280/11.35 Y |
| 3,003,777 | 10/1961 | Hilding | 280/11.35 B |
| 3,838,866 | 10/1974 | D'Alessio et al. | 280/11.35 K |

FOREIGN PATENTS OR APPLICATIONS

| | | | |
|---|---|---|---|
| 252,152 | 9/1948 | Switzerland | 280/11.35 Y |
| 126,223 | 6/1928 | Switzerland | 280/11.35 D |

*Primary Examiner*—M. Henson Wood, Jr.
*Assistant Examiner*—Milton L. Smith
*Attorney, Agent, or Firm*—Kurt Kelman

[57] ABSTRACT

In a type of ski binding comprising a plate supporting the sole of a shoe of a skier, the end of the plate associated with the tip of the sole being pivoted to the upper surface of a ski about a transverse fulcrum parallel to the upper ski surface, and the other plate end being supported on the upper ski surface by a transverse flange, the shoe is so affixed to the plate that the tip projects forwardly of the associated plate end while the shoe sole portion supporting the ball of the foot of the skier is in substantial vertical alignment with the fulcrum.

5 Claims, 3 Drawing Figures

SKI BINDING

The present invention relates to improvements in a ski binding adapted to be mounted on the upper surface of a ski and to hold a shoe on the ski.

Swiss U.S. Pat. No. 126,223 discloses such a ski binding comprising a plate for supporting the sole of the shoe and having two ends, and a part mountable on the upper ski surface and carrying a pivot extending transversely of, and substantially parallel to, the upper ski surface, one of the plate ends associated with the tip of the sole being pivotally mounted on the transversely extending pivot, and a flange extending transversely of the plate and projecting downwardly from the plate in the region of the other end for support on the upper ski surface. In this known binding, the entire sole is supported on the plate and the plate pivot is arranged in the region of the tip of the sole. This arrangement is disadvantageous for cross-country skiing where the skier more or less walks on the skis because it does not permit a physiologically correct movement.

In walking, the physiologically correct movement consists of rolling the sole over the ball of the foot. This cannot be accomplished with the known arrangement because the sole supporting plate is pivoted about an axis in the region of the tip of the shoe. This results not only in undue fatigue but also prevents the skier from optimally guiding the ski since the guiding force is transmitted to the ski in the region of the toes instead of the ball of the foot, as is physiologically correct. This is particularly disadvantageous when climbing because this requires optimal transmission of the guiding force to the ski.

It is the primary object of this invention to provide a ski binding of the indicated type which assures a physiologically correct movement in the sense of permitting the sole to roll over the ball of the foot when walking on skis.

It is another object of the invention to permit optimal transmission of guiding force to the ski when climbing, thus assuring, regardless of the type of ski and/or shoe used, easier walking on skis without undue fatigue and avoiding pressure on the foot and the ankle, for instance, due to physiologically incorrect movements.

These objects are accomplished in accordance with the present invention, in a ski binding of the indicated type, with means for affixing the shoe to the plate so that the tip projects forwardly of the one plate end and the shoe sole portion supporting the ball of the foot of the skier is in substantial vertical alignment with the pivot.

The shoe affixing means preferably comprises a flexible elongated element, such as a strap or cable, for engagement with the tip of the shoe.

Figure 1:
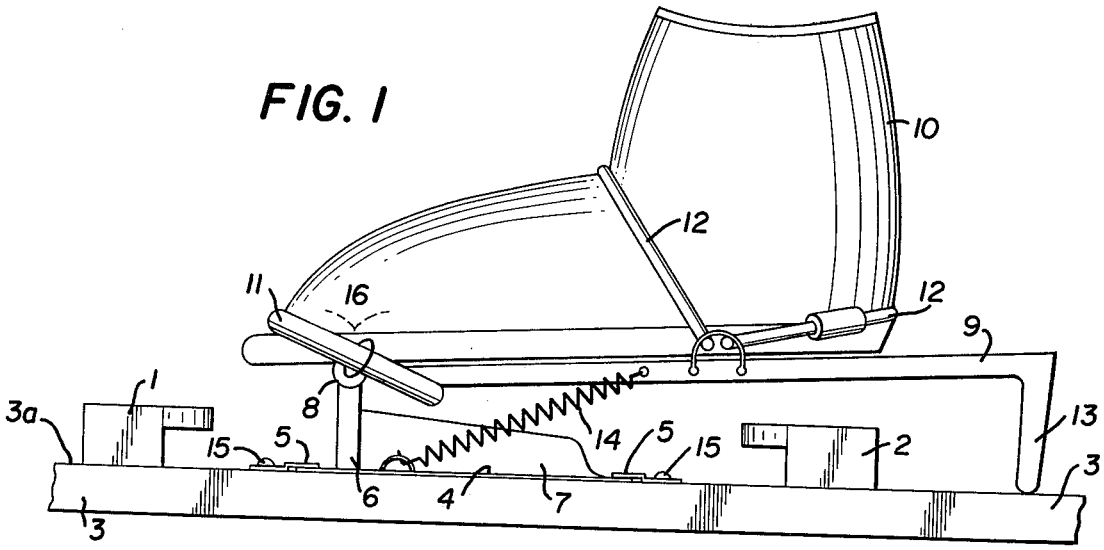
Figure 2:
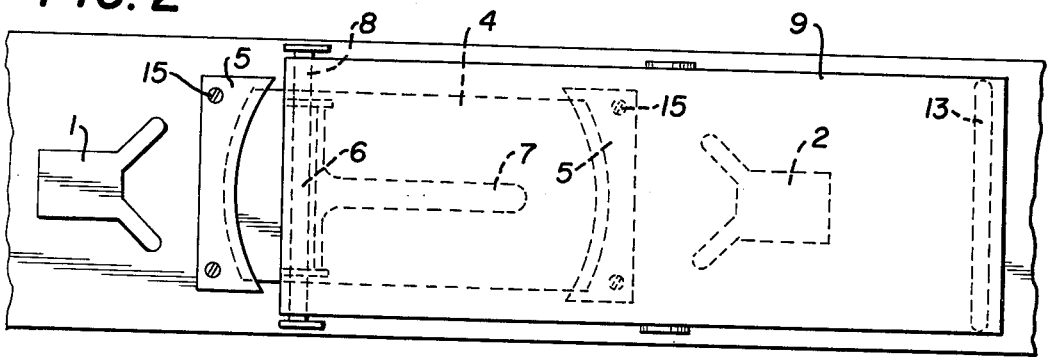
Figure 3:
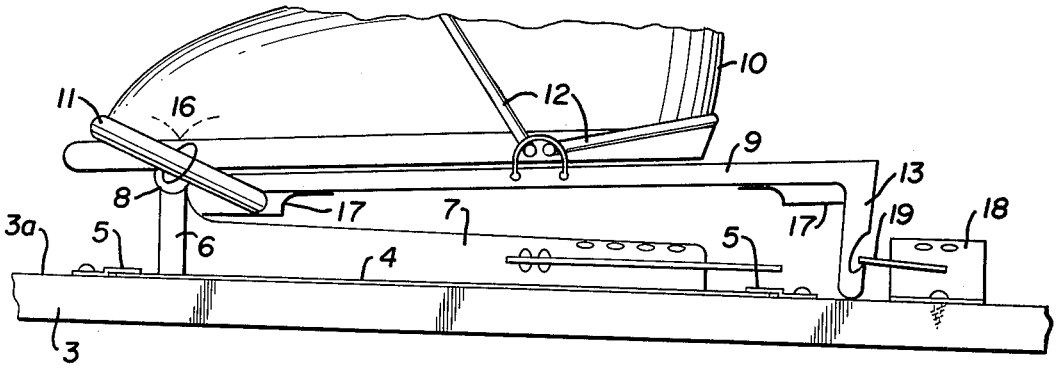

The invention will be described in detail in conjunction with specific embodiments illustrated in the accompanying drawing wherein FIG. 1 is a side elevational view showing, in addition to a conventional ski binding, the special binding adapted for walking on the ski, FIG. 2 is a top view of FIG. 1, with the shoe removed for illustrative purposes; and FIG. 3 is a side elevational view of a special binding according to this invention.

Referring now to the drawing, like reference numerals designate like parts functioning in a like manner in all figures to obviate redundancy in the description.

Only that portion of ski 3 whereon the binding is mounted is shown in the drawing.

In FIGS. 1 and 2, a conventional ski binding is schematically indicated at 1 and 2, this forming no part of the invention. In addition, a pair of clamps 5, 5 is screwed at 15 to upper surface 3a of the ski to enable the special binding of the present invention to be secured thereto. The illustrated clamps comprise an arcuate recess to receive and hold on the upper ski surface mounting plate 4 of the special binding. Web 6 projects upwardly from the mounting plate and extends transversely of the ski, this web being braced by reinforcing rib 7 extending in the longitudinal direction of the ski. Web 6 carries pivoting axle 8 extending substantially parallel to the upper ski surface and one of the ends of plate 9 is pivotally mounted on part 4, 6, 7 by means of the axle. Plate 9 supports the sole of shoe 10 and the one pivoted plate end is associated with the tip of the sole. Flange 13 extending transversely of plate 9 and projecting downwardly from the plate in the region of the other plate end supports the plate on the upper ski surface behind the heel portion 2 of the conventional binding.

Shoe 10 is affixed to the support plate by means of straps, cables or the like flexible elongated elements 11, 12, the affixing means being so arranged according to the invention that the tip projects forwardly of the one plate end and the shoe sole portion supporting ball 16 of the foot of the skier is in substantial vertical alignment with pivot 8, i.e. just above it.

Spring 14 biases plate 9 against pivotal movement about pivot 8, one end of the spring being attached to the underside of the plate with the other spring end attached to the upper surface of the ski eccentrically to axle 8. In this manner, the rear end of the ski will be biased against plate 9 when the ski is lifted, which considerably facilitates lateral climbing on a steep hill or in difficult terrain. When the ski is used for descent, the special binding may be detached by removing mounting plate 4 from clamps 5, 5 and conventional binding 1, 2 is used.

The ski of FIG. 3 is equipped solely with the special binding of this invention, all like parts being designated with the same reference numerals as the embodiment of FIGS. 1 and 2. In the embodiment of FIG. 3, mounting plate 4 extends almost to flange 13 of sole support plate 9. Flange 13 and transverse web 6 receiving pivoting axle 8 are detachably mounted on plate 9, clamp means 17 being provided on the plate for securing the web and the flange to the plate.

Thus, the transverse parts 6 and 13 may be detached and sole supporting plate 9 may be secured to clamps 5, 5 by clamping means 17, 17 to upper surface 3a of ski 3. Alternatively, the sole supporting plate may be held stationary by releasable latch means 18 engageable by flange 13. Latch 18 is screwed to the upper ski surface and comprises retaining spring 19 for releasable engagement with a notch in transverse flange 13. Such a latch is releasable at will and/or under an overload. For this purpose, it will be useful to make the bias of spring 19 adjustable to assure release under a given overload.

What is claimed is:

1. In a ski binding adapted to be mounted on the upper surface of a ski and to hold a shoe on the ski, the shoe having a sole with a tip and therebehind a portion supporting the ball of a foot of a skier, the binding comprising a plate for supporting the shoe sole and having two ends, and a pivot extending transversely of, and substantially parallel to, the upper ski surface, one of the plate ends associated with the tip of the sole being pivotally mounted on the transversely extending pivot, and a flange extending transversely of the plate and projecting downwardly from the plate in the region of the other end for support on the upper ski surface: a vertically extending part mountable on the upper ski surface and carrying the pivot at an upper end thereof, and means for affixing the shoe to the plate so that the tip projects forwardly of the one plate end and the shoe sole portion supporting the ball of the foot of the skier is in substantially vertical alignment with the pivot, the vertical extension of the binding part being about equal to the distance of the tip of the shoe sole from the binding part.

2. In the ski binding of claim 1, the shoe affixing means comprising a flexible elongated element for engagement with the tip of the shoe sole.

3. In the ski binding of claim 1, a spring biasing the plate against pivotal movement about the pivot.

4. In the ski binding of claim 1, a releasable latch means enagageable by the flange.

5. In the ski binding of claim 1, the pivot carrying part and the flange being detachably mounted on the plate, and clamp means on the plate for securing the part thereto.

* * * * *